US005745962A

United States Patent [19]

Richter

[11] Patent Number: 5,745,962

[45] Date of Patent: May 5, 1998

[54] ROLLER CLIP

[76] Inventor: Herbert Richter, Drosselweg 8, 75331 Engelbrand, Germany

[21] Appl. No.: 844,831

[22] Filed: Apr. 22, 1997

[51] Int. Cl.[6] ..... A44B 21/00; B42F 1/00

[52] U.S. Cl. ..... 24/488; 24/3.12; 24/304; 24/563

[58] Field of Search ..... 24/488, 563, 20 W, 24/3.12

[56] References Cited

U.S. PATENT DOCUMENTS

| | | | |
|---|---|---|---|
| 331,088 | 11/1885 | Sackett | 24/488 |
| 2,377,488 | 6/1945 | Fugazzi | 24/488 |
| 2,729,868 | 1/1956 | Manning | 24/488 |
| 3,889,313 | 6/1975 | Hulthen | 24/488 |
| 4,693,443 | 9/1987 | Drain | 24/488 |
| 5,056,197 | 10/1991 | Cohen | 24/304 |
| 5,331,721 | 7/1994 | Raum, Sr. | 24/3.12 |

*Primary Examiner*—Victor N. Sakran
*Attorney, Agent, or Firm*—Klaus J. Bach

[57] ABSTRACT

In a roller clip with a U-shaped body having resilient top and bottom legs, the top leg has an opening capturing a rolling means between the two legs and rotatably supporting the rolling means to permit insertion of a slip between the rolling means and the bottom leg for holding the slip. The bottom leg is provided with means for attaching the roller clip to a support surface.

5 Claims, 2 Drawing Sheets

ROLLER CLIP

BACKGROUND OF THE INVENTION

The invention resides in a roller clip for holding flat objects.

Clips for holding objects such as paper, receipts, or tickets are common and many designs exist. Basically, they all use two arms hinged or attached at one end and spring-loaded so that the other end can be opened and return automatically holding whatever may have been placed between the jaws of the clip. However, sometimes these designs are complicated to use, require the use of two hands to operate and are generally inconvenient. One hand has to operate the clip, the other has to hold the base on which the clip is mounted and a third hand is required to insert the object in the clip. Since most people only have two hands, this process can at times become complicated especially when in the middle of another task such as driving, or if that person is holding other objects in their hands as well.

It is the object of the invention to provide a clip which is simple to use, simple and inexpensive to manufacture, and effectively clips on the object inserted into it.

SUMMARY OF THE INVENTION

In a roller clip with a U-shaped body having resilient top and bottom legs, the top leg has an opening capturing a rolling means between the two legs and rotatably supporting the rolling means to permit insertion of a slip between the rolling means and the bottom leg for holding the slip. The bottom leg is provided with means for attaching the roller clip to a support surface.

Once attached to a larger object, a piece of paper or some thin flat material can be inserted into the clip with a minimum of effort, and with a single hand. Likewise, the piece of paper can be removed from the clip without tearing since there are no sharp edges to catch the paper.

The force exerted on the paper is great enough to hold the paper and not let it drop, yet won't hold so tightly that the paper would be difficult to insert or remove.

Details of the roller clip are explained in greater detail in the descriptions below.

DESCRIPTION OF PREFERRED EMBODIMENTS

Figure 1A:
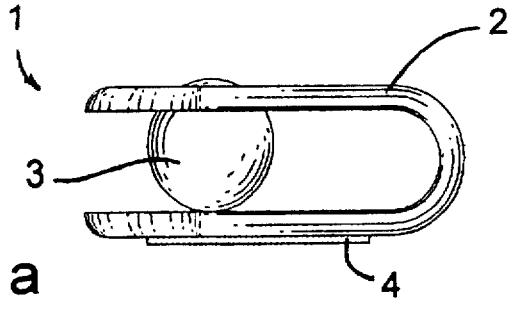
FIG. 1*a* is a profile of a roller clip using two spheres as rollers.
Figure 1B:
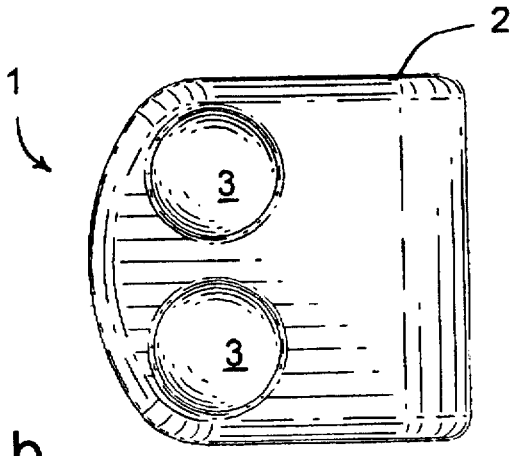
FIG. 1*b* shows the front view of the roller clip.
Figure 1C:
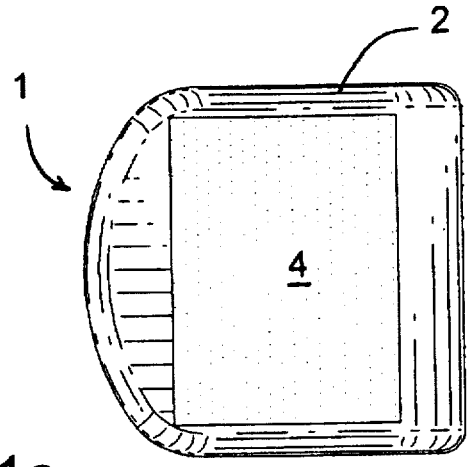
FIG. 1*c* shows the bottom view of the roller clips.

FIGS. 1*a* and 1*b* show a roller clip profile from the side and from the top, respectively. The body 2 is U-shaped in profile so as to have upper and lower legs 2*a* and 2*b*. The upper leg 2*a* has bearing openings 5 receiving rolling means 3, which in this embodiment are two spheres disposed between the two legs of the clip 1. The openings 5 are smaller than the spheres so that the spheres are partially received in the openings 5 and rotatably retained between the legs 2*a* and 2*b*.

Figure 2A:
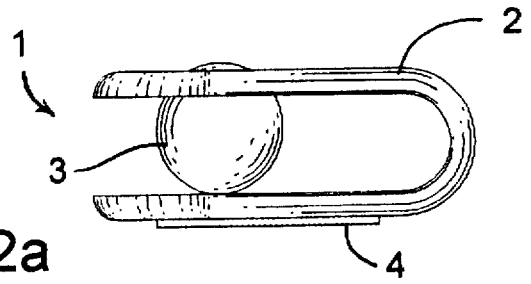
FIG. 2*a* is a profile of a roller clip using a cylinder as a roller.
Figure 2B:
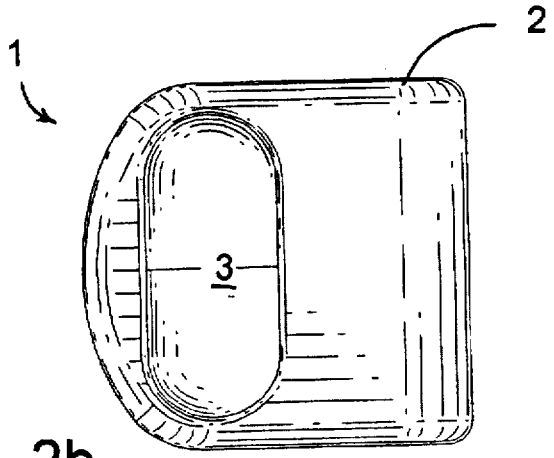
FIG. 2*b* shows the front view of the roller clip.
Figure 2C:
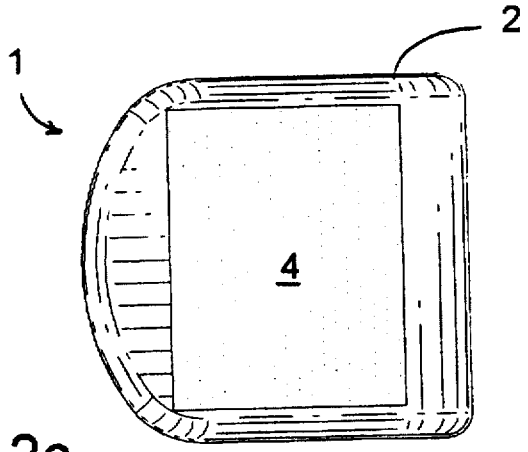
FIG. 2*c* shows the bottom view of the roller clip.

FIGS. 2*a* and 2*b* show a roller clip profile from the side and from the top respectively wherein however instead of two spheres, a cylindrical roller 3' with hemispherical ends is used as the roller means. Again, the tension between the two legs 2*a'*, 2*b'* holds the roller 3' in place using an elongated opening 5' shaped to receive the length of the cylindrical roller.

As shown in FIGS. 1*a* and 2*a* a double-sided adhesive pad 4 is disposed on the bottom leg 2*b*, 2*b'* for mounting the roller clip to a larger or stable base object. The pad 4 has adhesive on both sides; on one side for adhering to the roller clip and, on the other side, for mounting the roller clip to the base object. The pad 4 covers most of the bottom leg 2*b*, 2*b'* for maximum stability.

The invention is not limited to the embodiment shown and described herein. Rollers of other than cylindrical shape may be used for example. They may include rollers shaped like dumbbells or bodies that are V-shaped or squared to name a couple.

What is claimed is:

1. A roller clip comprising a U-shaped body having top and bottom legs such that said top leg is resiliently supported in spaced relationship from said bottom leg, said top leg having at least one opening, at least one rolling means of a size larger than said opening disposed between said legs so as to extend partially through said opening and being captured in said opening, said opening having circumferential wall portions forming a bearing structure for said rolling means to permit rotation of said rolling means when an object is inserted between said bottom leg and said rolling means, and means on said bottom leg for attaching said roller clip to a support structure.

2. A roller clip according to claim 1, wherein said rolling means is a sphere and said opening is round.

3. A roller clip according to claim 1, wherein said rolling means is a cylinder and said opening is oblong.

4. A roller clip according to claim 3, wherein said cylinder has hemispherical ends and said opening is elongated and is rounded at its ends.

5. A roller clip according to claim 1, wherein said means for attaching said roller clip to a support structure is a double-sided adhesive pad.

* * * * *